US007340195B2

(12) United States Patent
Watanabe et al.

(10) Patent No.: US 7,340,195 B2
(45) Date of Patent: Mar. 4, 2008

(54) IMAGE FORMING APPARATUS HAVING A SCATTERED TONER SUCKING PORT

(75) Inventors: Kanehiro Watanabe, Sagamihara (JP); Junichi Koiso, Hachioji (JP); Yasushi Koshimura, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 256 days.

(21) Appl. No.: 11/181,845

(22) Filed: Jul. 15, 2005

(65) Prior Publication Data

US 2006/0078348 A1 Apr. 13, 2006

(30) Foreign Application Priority Data

Oct. 8, 2004 (JP) ..... 2004-296003
Oct. 12, 2004 (JP) ..... 2004-297251

(51) Int. Cl.
*G03G 15/08* (2006.01)
*G03G 15/09* (2006.01)

(52) U.S. Cl. ..... 399/99; 399/103; 399/267

(58) Field of Classification Search ..... 399/98, 399/99, 103, 105, 267
See application file for complete search history.

(56) References Cited

U.S. PATENT DOCUMENTS 5,862,440 A * 1/1999 Christy et al. ..... 399/99
6,181,896 B1 * 1/2001 Zirilli et al. ..... 399/98
6,813,457 B2 * 11/2004 Yoshiki ..... 399/99
7,043,172 B2 * 5/2006 Koshimura et al. ..... 399/99
7,046,940 B2 * 5/2006 Kim et al. ..... 399/98
7,103,298 B2 * 9/2006 Satoh ..... 399/98
7,158,743 B2 * 1/2007 Uchida et al. ..... 399/267

FOREIGN PATENT DOCUMENTS

JP 4-355481 12/1992
JP 10-48949 2/1998
JP 2001-117363 4/2001

* cited by examiner

*Primary Examiner*—William J. Royer
(74) *Attorney, Agent, or Firm*—Finnegan, Henderson, Farabow, Garrett & Dunner, L.L.P.

(57) ABSTRACT

An image forming apparatus includes: an image carrier with an electrostatic latent image formed thereon; a developing device for developing the electrostatic latent image into a toner image, a developer carrier arranged opposite to the image carrier, for allowing a magnetic field generation member arranged inside the developer carrier, for forming a magnetized area of the magnetic brush in a predetermined area in the axial direction of the developer carrier; and a scatter toner sucking port arranged at a position other than a position opposite to the magnetized area of the developer carrier.

11 Claims, 8 Drawing Sheets

IMAGE FORMING APPARATUS HAVING A SCATTERED TONER SUCKING PORT

This application claims priority from Japanese Patent Application No. JP2004-296003 filed on Oct. 8, 2004 and JP2004-297251 filed on Oct. 12, 2004, which are incorporated hereinto by reference.

BACKGROUND OF THE INVENTION

The present invention relates to an image forming apparatus such as a copying machine, a printer and a facsimile machine using an electrophotographic technology, particularly to an image forming apparatus characterized by improved means for sucking toner scattering from a developing device.

The image forming apparatus for forming an image based on the electrophotographic technology generally utilizes powder-like toner for development and image formation.

In many cases, some measures must be taken to prevent toner from scattering in the process of development using powder-like toner. The electrophotographic image forming apparatus is mostly provided with a sealing means for sealing the position where toner is more likely to scatter, or sucking means for sucking toner scattering from the developing device.

The prior art having been disclosed so far includes the art of sealing both ends of a development area using a sealing means (Patent Document 1); the art of discharging a sucked toner in an axial direction, downstream from an opening of a development roller as a developer carrier, using a sucking means (Patent Document 2); and the art for sucking toner coming between magnetic brushes and removing it by a development housing designed in a double structure and a portion corresponding to the magnetic brush provided with a wall to perform rubbing (Patent Document 3). However, the art disclosed in Patent Document 1 has a problem with the degree of sealing of the sealing means rubbed against a development roller. The art described in Patent Documents 2 and 3 have a problem of a carrier, together with toner, being sucked. Patent Documents 2 and 3 have a further problem of how to increase a sucking apparatus and power since the opening for sucking is long in the axial direction. As a result, the installation space, power consumption and noise must be increased. In particular, a non-magnetized area in the vicinity of both ends of the development roller is found in the opening for suction provided close to the development roller, and therefore, toner tends to scatter. Further, air flow caused by rotation of the development roller flows through the development housing, and toner tends to be emitted outside the development housing from the position close to both ends of the development roller. Thus, toner tends to be scattered in the portion close to both ends of the development roller. Patent Documents 2 and 3 do not provide a solution for this problem.

[Patent Document 1] Official Gazette of Japanese non-examined Patent Publication No. 10-48949

[Patent Document 2] Official Gazette of Japanese non-examined Patent Publication No. 2001-117363

[Patent Document 3] Official Gazette of Japanese non-examined Patent Publication No. 4-355481

SUMMARY OF THE INVENTION

Disclosed herein are image forming apparatus. In one embodiment, the image forming apparatus includes an image carrier on which a latent image is formed, a developing device for developing the latent image to form a toner image, and a scattered toner sucking port. This scattered toner sucking port may be provided in a position other than a position opposite to the magnetized area for sucking a scattered toner.

In a further embodiment, the developing device may include a developer carrier and a magnetic field generating member. The developer carrier may be provided in a position opposite to the image carrier. The magnetic field generating member may be provide in side the developer carrier.

In yet another embodiment, the developing device may include a developer carrier, a magnetic field generating member, an opening portion, and a sealing member.

DETAILED DESCRIPTION OF THE PREFERRED EMBODIMENT

Figure 1:
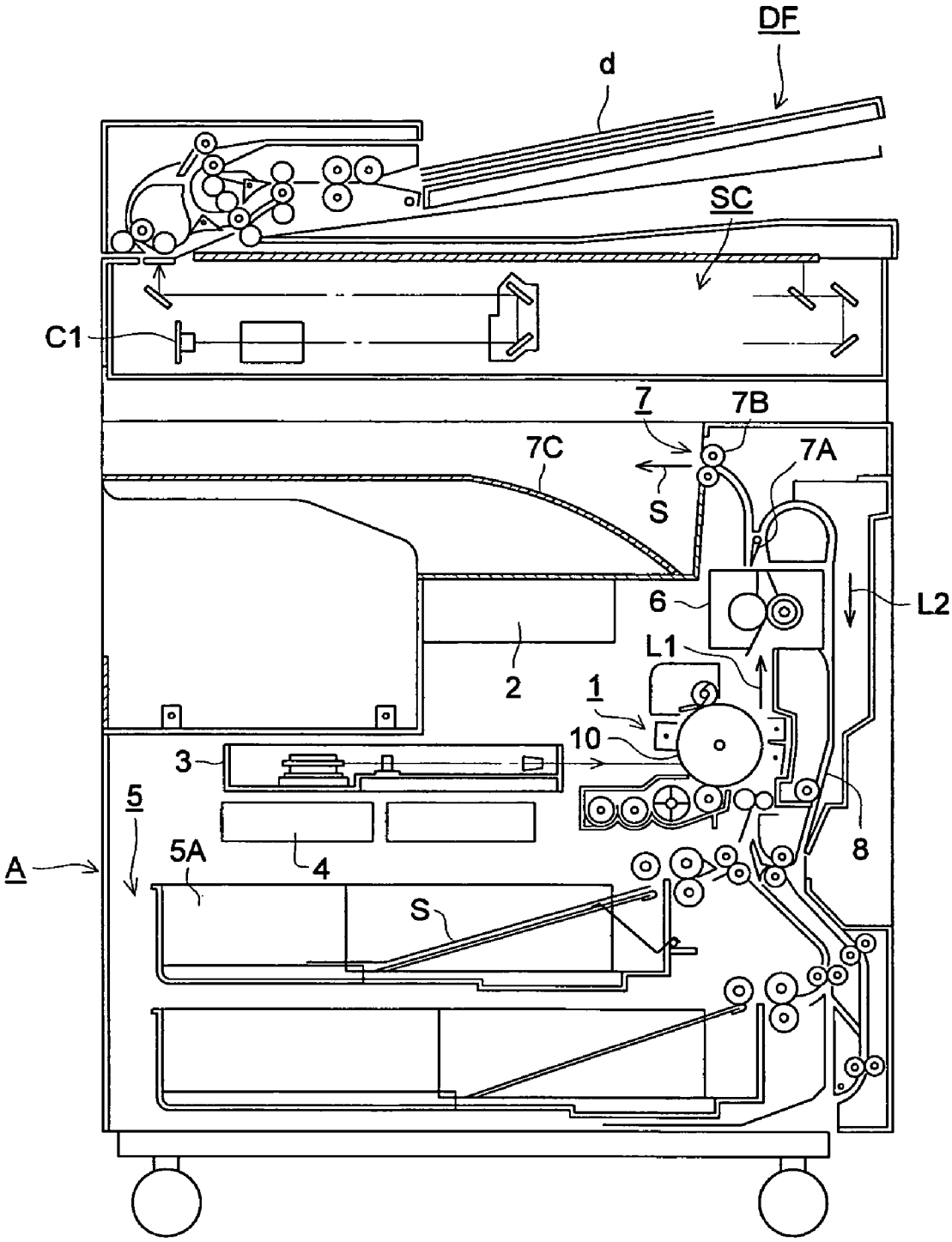
FIG. 1 is an overall configuration diagram representing an image forming apparatus equipped with a developing device according to the present invention.

Embodiments will now be described, by way of example only, with reference to the accompanying drawings which are meant to be exemplary, not limiting, and wherein like elements are numbered alike in several Figures, in which:

Referring to the drawings, the following describes the embodiments of an image forming apparatus equipped with a developing device of the present invention.

FIG. 1 is an overall configuration diagram representing the image forming apparatus equipped with a developing device according to the present invention.

The image forming apparatus A in FIG. 1 is provided with an image forming section 1, an image processing section 2, an image writing section 3, a high voltage power supply 4, a sheet feed section 5, a fixing device 6, an ejection section 7 and a sheet re-feed section (ADU) 8 for automatic two-sided copying.

An image scanner SC and an automatic document feeder DF are mounted on the top portion of the image forming apparatus A. An ejection tray 7C or a sheet finisher (not illustrated) can be connected on the ejection section side at the upper left of the image forming apparatus A in FIG. 1.

A document d placed on a document platen of the automatic document feeder DF with the first surface facing upward is fed to a scanning position. One-side or both-sides the document d are scanned by an optical system of the image scanner SC, and the scanned images are read by a CCD image sensor C1.

An analog signal having undergone photoelectric conversion by the CCD image sensor C1 is subjected to analog processing, analog-to-digital conversion, shading correction and image compression in the image processing section 2. The signal is then sent to the image writing section 3.

In the image writing section 3, an optical output from a semiconductor laser is applied to a photoreceptor 10 of the image forming section 1, whereby a latent image is formed. In the image forming section 1, processing of electrostatic charging, exposure, development, transfer, separation and cleaning are performed, and an image is transferred onto a sheet S fed from the sheet feed section 5. The sheet S carrying the image is subjected to fixing by the fixing device 6, and is ejected from the ejection section 7 to the ejection tray 7C. Alternatively, the sheet 5, having an image processed on one side, is fed to the sheet re-feed section 8 by a sheet ejection path switching plate 7A and is ejected to the ejection tray 7C by the sheet ejection roller 7B of the ejection section 7 after having undergone duplex image processing in the image forming section 1.

In FIG. 1, on the right side within the image forming apparatus A, a sheet feed cassette 5A of the sheet feed section 5 is arranged downward in the vertical direction of the image forming apparatus A, with the image forming section 1 at the center, whereas the fixing device 6 and ejection section 7 are arranged upward. This vertical arrangement forms an almost vertical sheet conveyance path L1. The sheet S fed from the sheet feed cassette 5A is fed along the sheet conveyance path L1 and is ejected out of the image forming apparatus A.

A sheet conveyance path L2 in the sheet re-feed section 8 is formed approximately in parallel to this vertical sheet conveyance path L1. Formation of the aforementioned sheet conveyance paths L1 and L2 provides the shortest sheet conveyance path leading to the ejection section 7 from the sheet feed cassette 5A.

Figure 2:
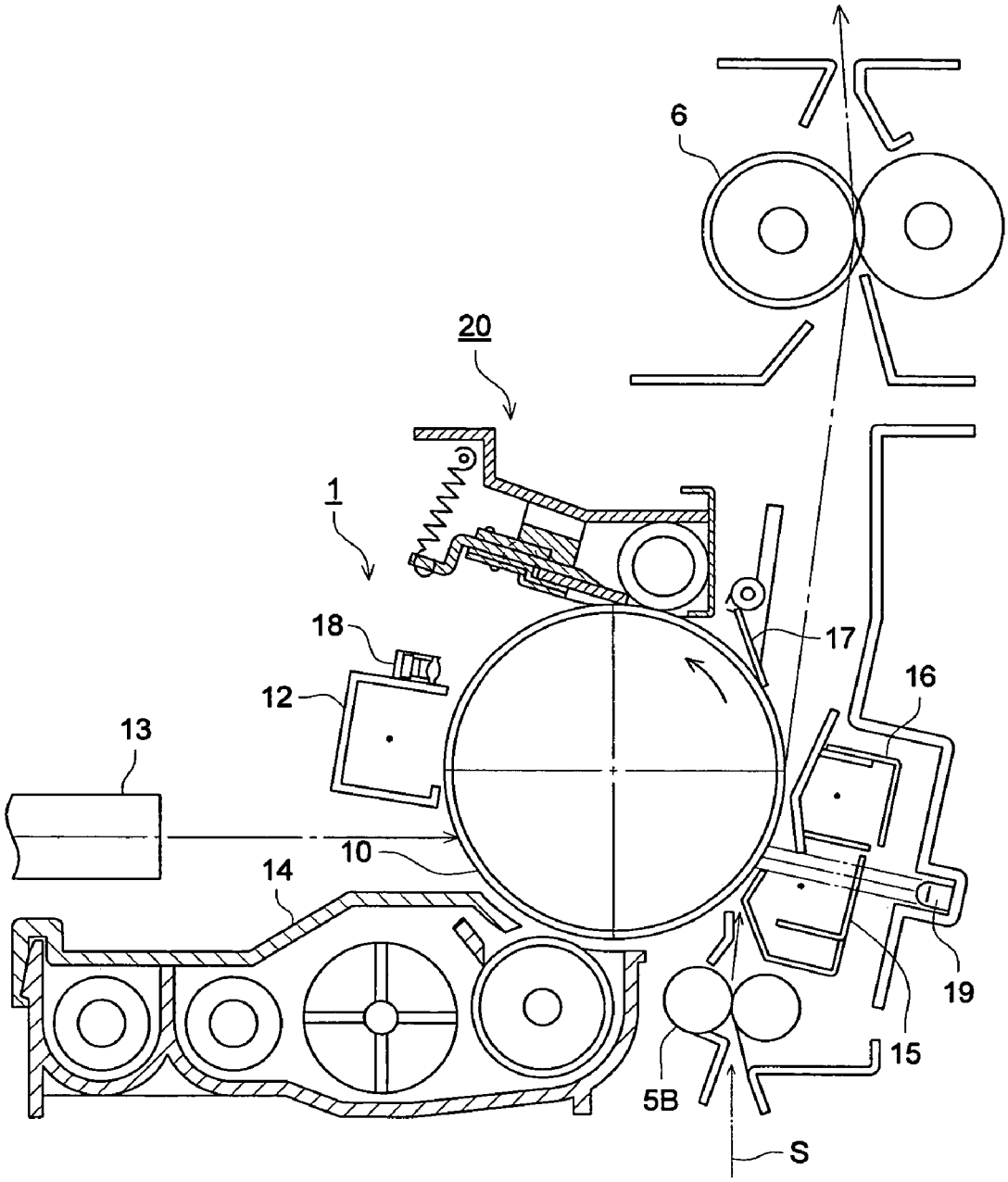
FIG. 2 is a cross sectional view showing the major sections of the image forming apparatus as an embodiment of the present invention.

FIG. 2 is a cross sectional view showing the major sections of the image forming apparatus A as an embodiment of the present invention.

In FIG. 2, numeral 10 denotes a photoreceptor as an image carrier composed of an organic or inorganic photoconductive layer arranged on the surface of a substrate. A photoconductive layer is provided in the image forming area of the photoreceptor 10, but not on both ends of the image carrier.

The photoreceptor 10 is driven and turned in the direction indicated by the arrow Numeral 12 denotes a corona charging device to uniformly charge the surface of the photoreceptor 10. Numeral 13 is an image exposure means, which applies an optical image on the photoreceptor 10 to form an electrostatic latent image. Numeral 14 indicates a developing device, which forms a toner image by developing an electrostatic latent image formed on the photoreceptor 10. Numeral 58 represents a resist roller for feeding the sheet S fed from the sheet feed cassette 5A, to the transfer position synchronized with formation of an electrostatic latent image on the photoreceptor 10. Numeral 15 is a corona discharge device for transferring the toner image on the photoreceptor 10, onto the sheet S. Numeral 16 denotes a corona discharge device to separate the sheet P subjected to transfer, from the surface of the photoreceptor 10. Numeral 17 indicates a separation claw to be pressed against the surface of the photoreceptor 10, and is used to separate the sheet S attached on the photoreceptor 10. Numeral 18 represents an electric charge eliminator prior to charging, and 19 is a simultaneous transfer/exposure section. Numeral 6 shows a fixing device and 20 indicates a cleaning apparatus.

Figure 3:
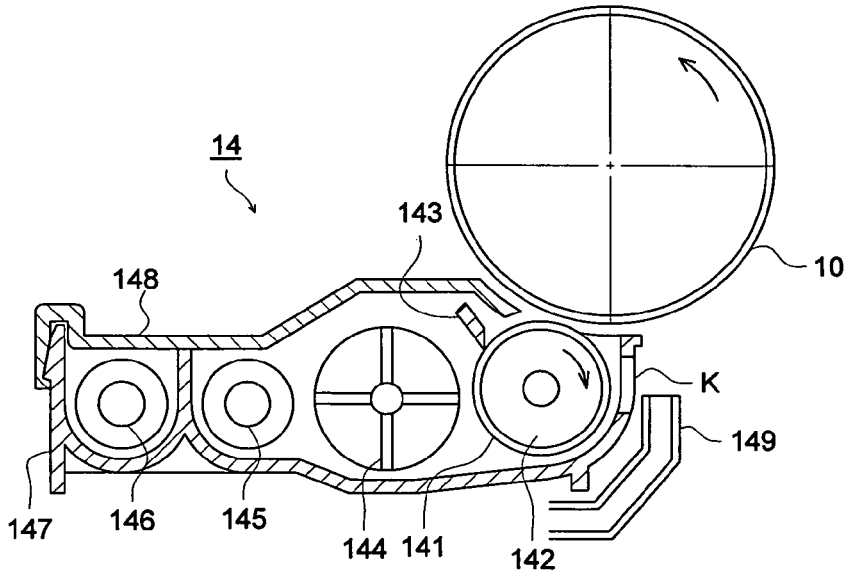
FIG. 3 is a cross sectional view of a developing device as an embodiment of the present invention.
Figure 4:
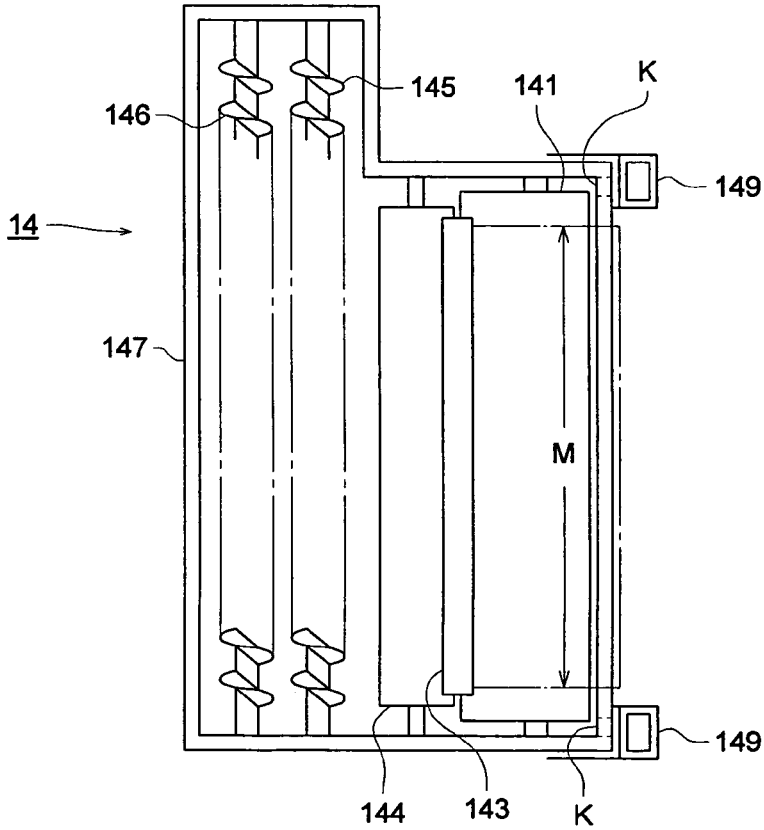
FIG. 4 is a top view of the developing device with an upper cover removed.

FIG. 3 is a cross sectional view of a developing device 14 as an embodiment of the present invention. FIG. 4 is a top view of the developing device 14 with the upper cover 148 removed.

A developer carrier 141 rotates in the direction indicated by the arrow in FIG. 3. A stationary magnet 142 for development as a magnetic field generating member is provided inside a predetermined area extending in the axial direction of the developer carrier 141. A carrier in the developer is charged by mutual friction by agitation and conveyance inside the developing device 14, so that toner is adsorbed electrostatically. The developer composed of the toner and carrier electrostatically adsorbed is formed and deposited as a so-called magnetic brush on the outer circumferential surface of the developer carrier 141, within a magnetized area M of a predetermined area formed by the magnetic force of the stationary magnet 142 for development. The developer layer formed as a magnetic brush is regulated when passing through a layer thickness regulating member 143 by the rotation of the developer carrier 141. The developing device 14 is equipped with an aperture where the outer circumferential surface of the developer carrier 141 is exposed, and this aperture is located at the development area where the developer carrier 141 is opposite to the photoreceptor 10, and toner is transferred to the surface of the photoreceptor 12. At the developing position, the toner in the developer having passed through the layer thickness regulating member 143 transfers from the outer circumferential surface of the developer carrier 141 to the electrostatic latent image on the photoconductor 10, whereby development is performed.

A pair of agitation and conveyance screws 145 and 146, and a rotary paddle 144 are arranged in a developer container 147 as a developing device main body. The agitation and conveyance screws 145 and 146 feed newly supply toner to the developer carrier 141 while mixing it with the developer in the developer container 147, and agitating them. The agitation and conveyance screws 145 and 146 are both rod-like screw members. They feed the toner; one of them agitates the developer from the forward to the backward portion, and the other from the backward to the forward portion. The toner supplied drops on the developer circulated by the agitation and conveyance screws 145 and 146, and is mixed and agitated, so that the toner is ejected toward the rotary paddle 144. The developer mixed and agitated with the ejected toner is further agitated by the turbine-like rotary paddle 144 and is supplied to the developer carrier 141.

The developing device 14 is mounted on a drum cartridge frame member (not illustrated) together with the photoreceptor 10, thereby constituting a drum cartridge. Image formation is carried out with the drum cartridge fixed on the image forming apparatus main body. It can be pulled out of the image forming apparatus main body or removed therefrom. The developer can be replaced, with the developing device 14 removed from the drum cartridge frame member. Numeral 148 denotes an upper cover of the developer container 147. Two opening portions K are formed on a side wall (not illustrated) of the developer container 147 adjacent to and opposite to the outer circumferential surface of the developer carrier 141 in parallel. These opening portions K are located close to both ends of the developer carrier 141 (outside the magnetized area M). Outside the developer container 147, two scattered toner sucking ports 149 are arranged, downstream in the rotary direction of the developer carrier 141 and close to each opening portion K, in the development position where the photoreceptor 10 and developer carrier 141 are opposed to each other. Provided on the image forming apparatus main body, the two scattered toner sucking ports 149 communicate with a fan (not illustrated) via a duet (not illustrated).

Figure 5:
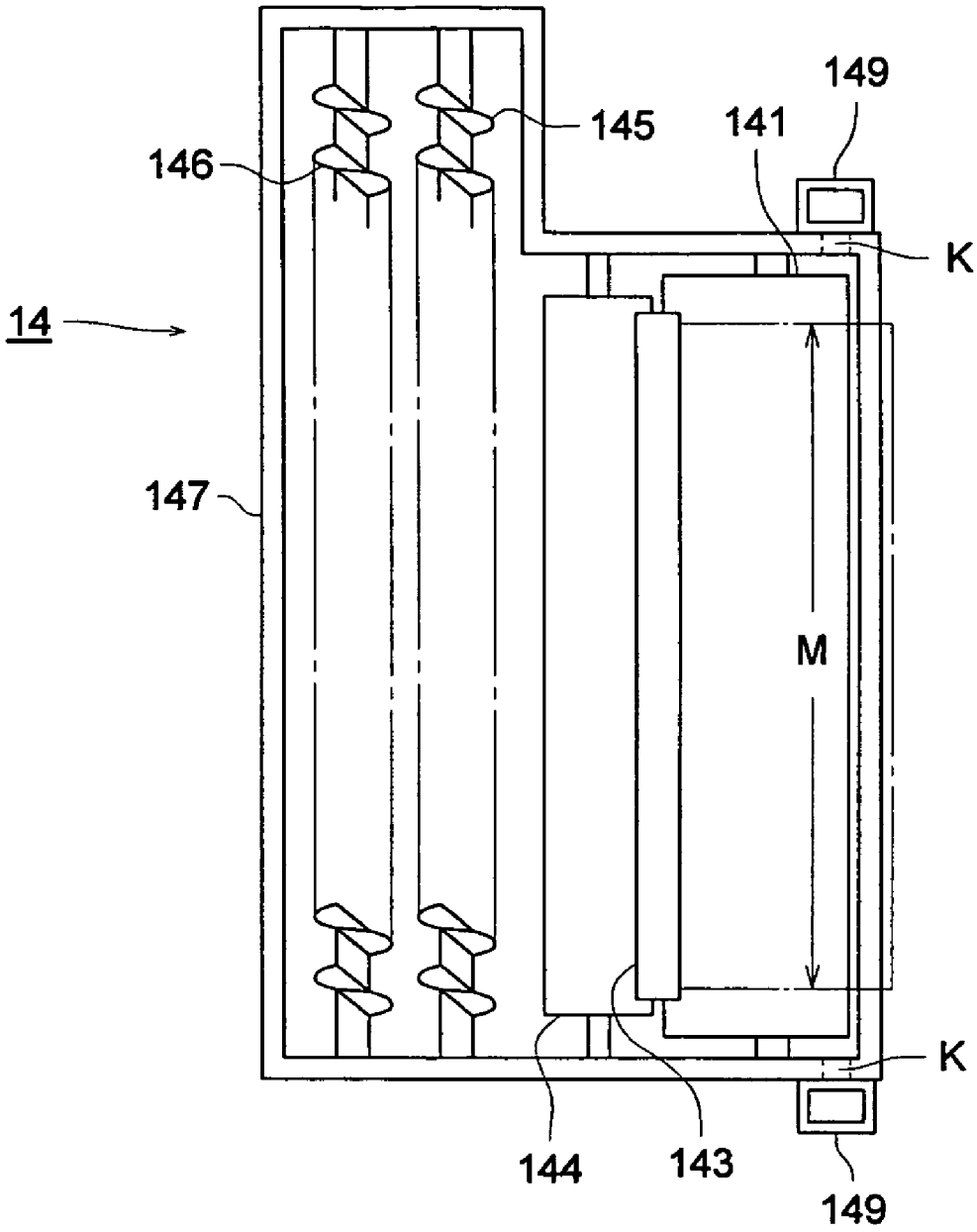
FIG. 5 is an example of a variation showing the positions of an opening portion and a scattered toner sucking port.

In the present embodiment, the opening portions K are formed on the side wall of the developing device 14 opposite to the outer circumferential surface of the developer carrier 141. Each of the scattered toner sucking ports 149 is arranged close to each of the opening portions K as ports for sucking scattered toner. However, it is to be understood that the present invention is not restricted to this embodiment. For example, it is also possible to arrange such a configuration that each opening portion K is formed on the side wall of the developer container 147 opposite to the side of the developer carrier 141, as shown in FIG. 5, and two toner sucking ports 149 as ports for sucking scattered toner are arranged close to the each opening portion K. In this ease, the scattered toner having flown to both ends of the developer carrier 141 in the axial direction with no way out can be effectively sucked, without running against the flow.

[Developing Device]

Figure 6:
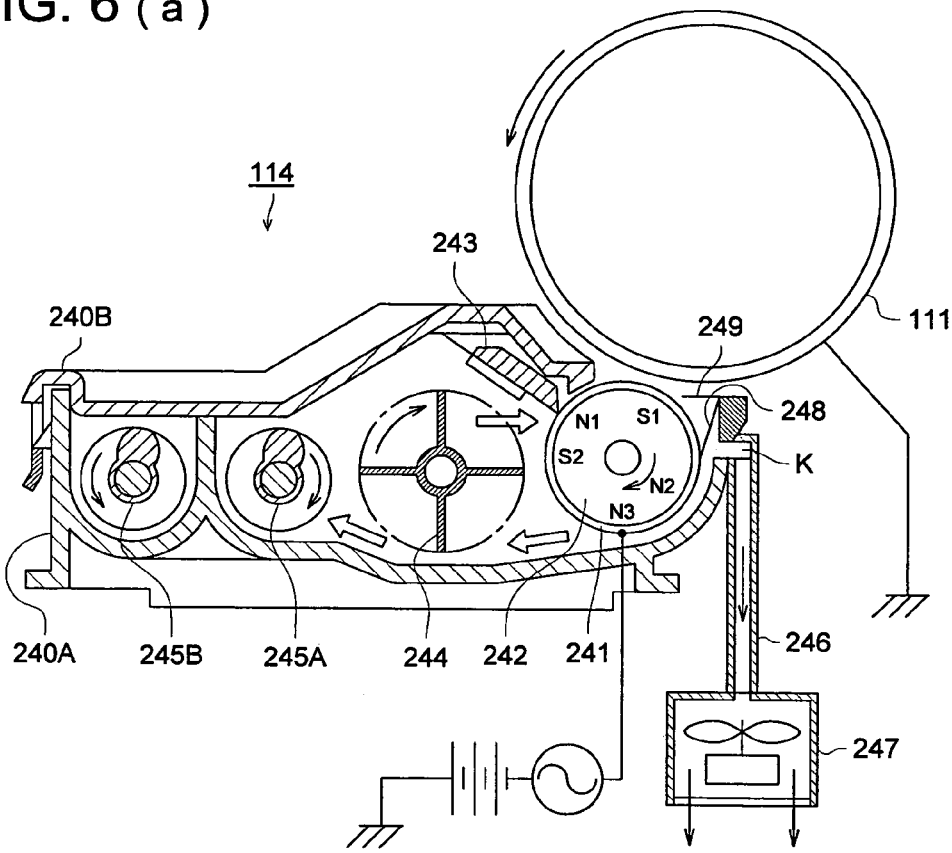
FIGS. 6(*a*) and (*b*) are a cross sectional view and a partially enlarged view of a developing device as a second embodiment of the present invention.
Figure 6:
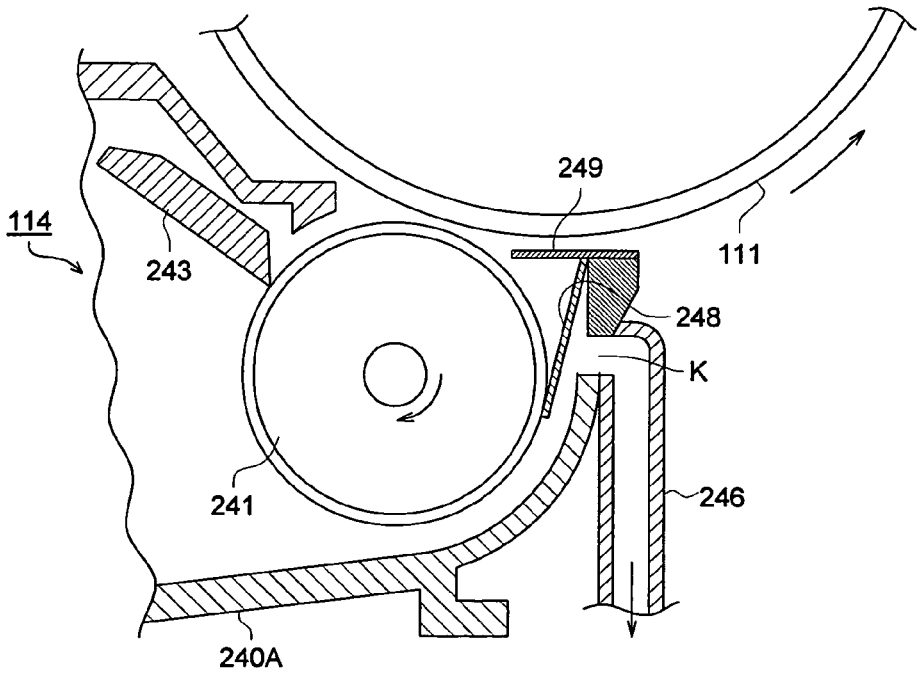
Figure 7:
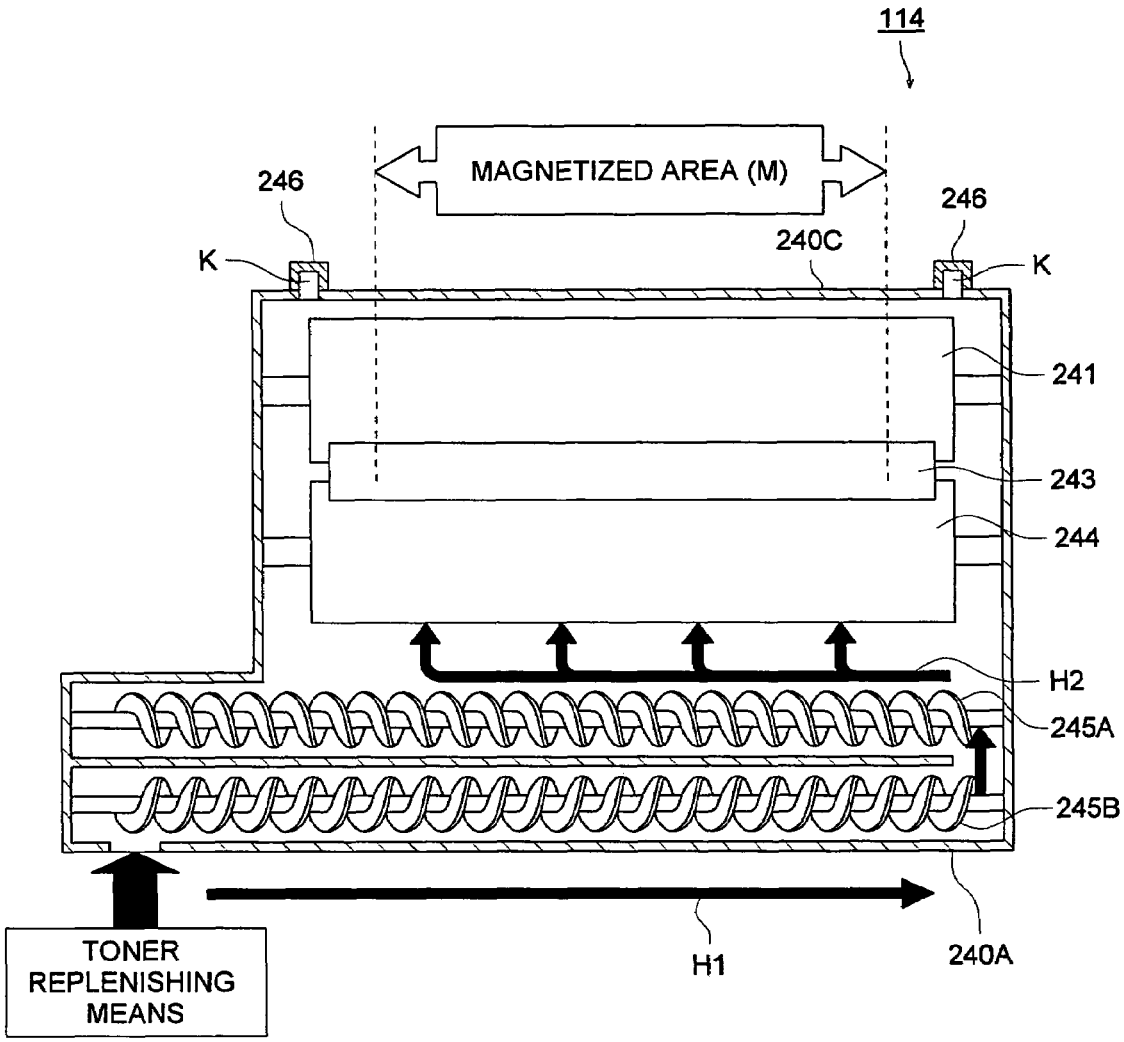
FIG. 7 is a plan view of the developing device with its upper cover removed.
Figure 8:
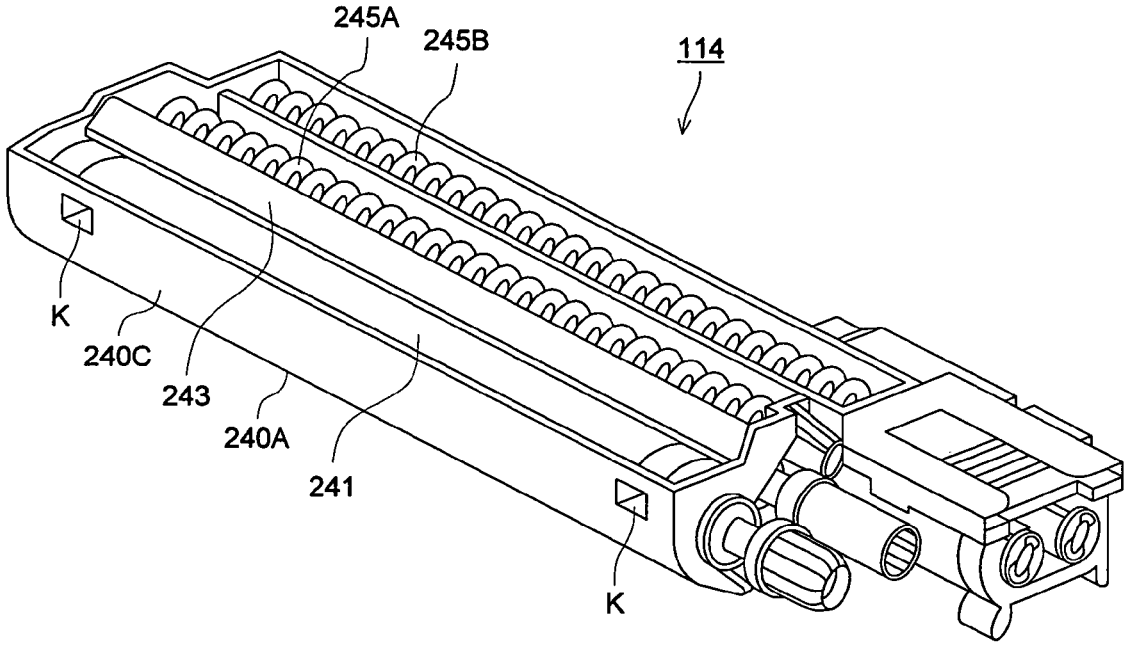
FIG. 8 is a perspective view of the developing device.

FIG. 6(*a*) is a cross sectional view of a developing device 114 as a second embodiment of the present invention. FIG. 6(*b*) is a partially enlarged view of the developing device 114. FIG. 7 is a plan view of the developing device 114 with its upper cover 240B removed. FIG. 8 is a perspective view of the developing device 114.

The developing device 114 is constituted by a developing container 240A as a developing device main body, upper cover 240B, developer carrier 241, stationary magnet 242, layer thickness regulating member 243, rotary paddle 244, and agitation and conveyance screws 245A and 245B.

The developer carrier 241 incorporates the stationary magnet 242 as a magnetic field generating member, and rotates in the direction indicated by the arrow. Electrically charged by mutual friction, the developer containing toner attached around the carrier forms a so-called magnetic brush by depositing within the magnetized area M on the surface of the developer carrier 241. The thickness of the developer layer is determined by the layer thickness regulating member 243. The developer is fed to the development area opposite to an image carrier 111, and the development is carried out.

The pair of agitation and conveyance screws 245A and 245B and rotary paddle 244 are rotatably supported inside the developing container 240A. They feed newly supplied toner to the developer carrier 241 while mixing and agitating the toner with the developer in the developing container 240A. The agitation and conveyance screws 245A and 245B are both rod-like screw members. They convey the developer while the agitation and conveyance screw 245B agitates the developer in the direction marked by "H1" in FIG. 7, and the agitation and conveyance screw 245A agitates the developer in the direction marked by "H2". The toner supplied drops on the developer circulated by the agitation and conveyance screws 245A and 245B, and is mixed and agitated, so that the toner is ejected toward the rotary paddle 244. The developer mixed and agitated with the ejected toner is further agitated by the rotary paddle 244 and is supplied to the developer carrier 241.

The developer carried by the developer carrier 241 is regulated to form a predetermined thickness of the developer layer by the layer thickness regulating member 243. Then it is fed to the developer area where the image carrier 111 is located opposite to developer carrier 241.

[Inner Contamination Preventive Section]

Opening portions K are formed on a side wall 240C of the developing container 240A adjacent to and opposite to the surface of the developer carrier 241 in parallel. These opening portions K are located close to both ends of the developer carrier 241 (outside the magnetized area M). Each opening portion K communicates with each toner sucking port 246. The sucking section equipped with the toner sucking port 246 and fan motor 247 is arranged on the image forming apparatus main body in such a way that it can be connected to the opening portions K or separated therefrom. However, part of the toner sucking port 246 may be arranged on the side of the developing device 114.

The toner scattering in the development area in which the image carrier 111 and the developer carrier 241 oppose is sucked by two opening portions K, and is ejected out of the image forming apparatus A by the fan 247 after passing through the toner sucking port 246.

Upstream from the opening portion K of the developing container 240A in the direction of rotation of the developer carrier 241, the base of first sealing member 248 is fixed to the part of the inner wall of the developing container 240A. The free end of the first sealing member 248 is in slight contact with the surface of the developer carrier 241 to cover the area close to the opening portion K.

The first sealing member 248 is an elastic substance composed of a resin material containing a conductive material such as carbon, formed in a film-like thin plate, or no elastic substance of the resin material composed of a film-like thin plate, with a conductive film formed thereon. Accordingly, it does not damage the surface of the developer carrier 241 with which the end of the first sealing member 248 is in slight contact.

The first sealing member 248 composed of the conductive material is held at the same electric potential as that of the developer carrier 241. It prevents the electrostatically charged scattered toner from depositing even if it is attached thereto.

The aperture of the developing area of the developing device 114 is formed to open in the upward direction. The first sealing member 248 is arranged in a tilted form so that the end side in contact with the developer carrier 241 is lower. This arrangement allows the toner adhering to the first sealing member 248 to fall off under its own weight along the first sealing member 248 so that the toner is collected into the developing device 114.

Figure 9:
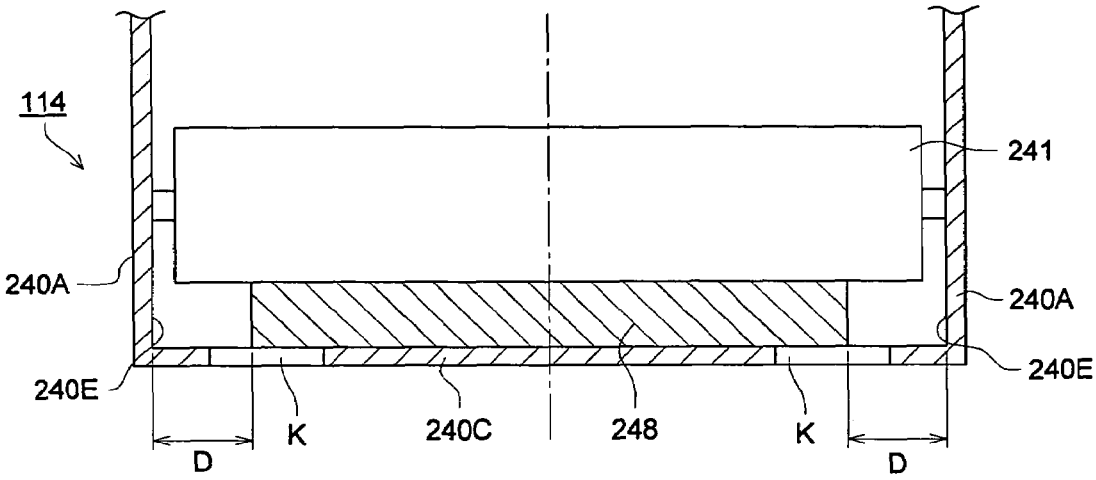
FIGS. 9(*a*) and 9(*b*) are a partial cross sectional view showing a portion close to a first sealing member of a developing device and a partial cross sectional view showing a portion close to a second sealing member of the developing device.
Figure 9:
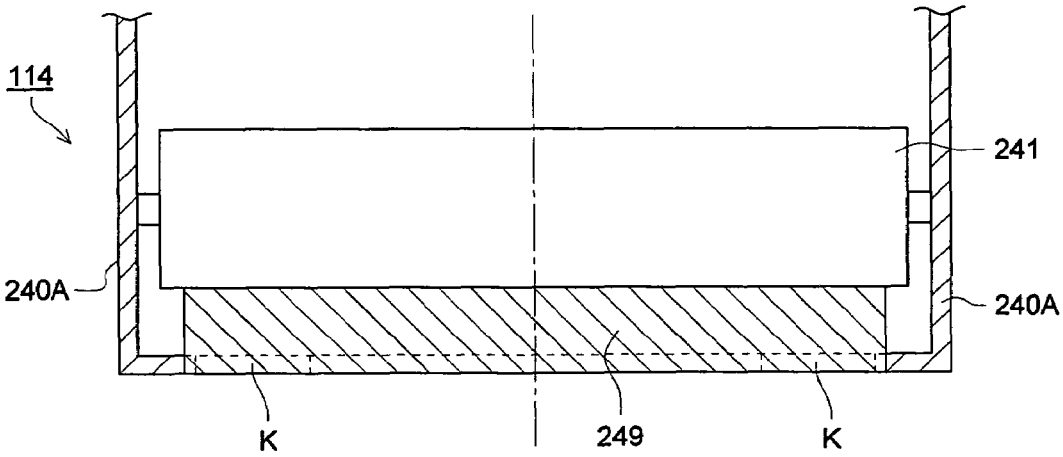

FIG. 9(*a*) is a partial cross sectional view showing the portion close to the first sealing member 248 of the developing device 114.

The first sealing member 248 is shorter than the distance between both ends of the developer carrier 241, and both ends of the first sealing member 248 are 5 mm or more apart from an inner wall surface 240E of the developing container 240A. Further, the first sealing member 248 is set within the range of covering at least a part of each of the opening portion K. This structure provides a reliable way of sucking flue floating scattered toner.

TABLE 1

| Distance between the inner wall of the developing container and the end of the first sealing member (D) | Evaluation result |
|---|---|
| 0 mm | C |
| 2 mm | C |
| 4 mm | B |
| 5 mm | A |
| 6 mm | A |

C: Much toner emitted
B: Some toner emitted
A: No toner emitted

Table 1 shows the result of test to check the influence of the distance D upon the emission of toner, the distance D being the distance between the inner wall surface 240E of the developing container 240A and the end of the first sealing member 248.

When the distance D is 5 mm or more, a satisfactory result has been obtained, without toner being emitted. When the distance D is 4 mm or less, a greater amount of toner tends to be emitted as the end of the first sealing member 248 is closer to the inner wall of the developing container 240A.

To be more specific, when the distance between the inner wall surface 240E of the developing container 240A and the end of the first sealing member 248 is 5 mm or more, the scattered toner flowing to the end portion is correctly led to the opening portion K side through the gap. If the distance is smaller, the scattered toner flowing to the end portion is emitted through the aperture, without being led to the opening portions side, the aperture being the portion where the outer peripheral surface of the developer carrier 241 is exposed.

In the meantime, the total length of the first sealing member 248 must be sufficient to cover at least a part of each of the opening portions of the developing device 114. This length correctly leads the toner scattered within the magnetized area M. to the opening portions K. Further, in ease that each opening portion K is completely covered, and the length is determined in such a way that the gap of 5 mm or more is formed between both ends and the inner wall surface 240E of the developing container 240A, then the toner scattered upstream from the first sealing member 248 is correctly led from the opening portion K to the toner sucking port 246 through the gap. At the same time, this arrangement effectively prevents the toner scattered downstream from the first sealing member 248, from being transmitted to the upstream side through the gap.

Further, in the second embodiment, it is also possible to arrange such a configuration that the opening portion K is formed on the side wall opposite to the side of the developer carrier 241, and the toner sucking port 246 is arranged close to the opening portion K, as given in FIG. 5 showing an example of a variation of the first embodiment.

FIG. 9(*b*) is a partial cross sectional view showing the portion close to a second sealing member 249 of the developing device 114.

The second scaling member 249 is fixed on the substantially horizontal wall surface of the developing container 240A close to the aperture of the developing device 114, upstream to the first sealing member 248 in the direction of the rotation of the developer carrier 241. The second sealing member 249 is set to cover a distance longer than the distance between end faces of two opening portions K formed close to both ends in the axial direction of the developer carrier 241. The free end of the second sealing member 249 is close to the outer circumferential surface of the developer carrier 241. This arrangement completely avoids that the floating toner emits to the image forming apparatus A through the aperture of the developing device 114.

The aforementioned image forming apparatus A ensures the scattered toner or the like to be sucked and collected by the sucking section, first sealing member 248, second sealing member 249, and fan motor 247. At the same time, it effectively prevents the interior of the image forming apparatus A from being contaminated by the scattered toner or flue like. Thus, the problems involving fogging image or toner scattering on the image area, for example, can be effectively solved.

The aforementioned simple structure effectively prevents toner from being scattered from the position close to the both ends of the developer carrier 241. The port 246 for sucking the scattered toner is arranged at a position other than the position opposite to the magnetized area M of the developer carrier 241 where scattered toner is concentrated. This arrangement allows use of a smaller size and a shorter duct for sucking, and saves an installation area. Further, the carrier contained in the developer is basically adsorbed in the magnetized area M. This ensures effective absorption of only the scattered toner.

Further, the aforementioned structure provides a reliable way of preventing toner from being scattered from the position close to both ends of the developer carrier 241, and ensures well-balanced suction of scattered toner.

The first scaling member 248 shorter than the developer carrier 241 in the axial direction and long enough to cover at least one of each opening portion K is arranged downstream in the direction of rotation of the developer carrier 241 with respect to the development position and between the developer carrier 241 and the opening portion K, in such a way as to get in light contact with the outer circumferential surface of the developer carrier 241. This arrangement provides a reliable way of preventing toner from being scattered from the position close to both ends of the developer carrier 241, and ensures well-balanced suction of scattered toner.

The first sealing member 248 is formed by conductivity and is provided with the same potential as that of the developer carrier 241. This arrangement prevents the scattered toner having an electrical charge from being deposited on the first sealing member 248.

In the developing device 114, the aperture of the development area where the outer circumferential surface of the developer carrier 241 is exposed is formed in the upward section. The first sealing member is tilted so that the end side in contact with the developer carrier 241 is low. Because of this structure, the toner attached to the first sealing member drops under its own weight along the first sealing member, and is collected into the developing device main body 240A.

The first sealing member provides a reliable way of sucking the floating toner when both ends in the longitudinal direction are 5 mm or more apart from the inner wall surface 240E of flue developing device slain body 240A.

The second sealing member long enough to completely cover each of the opening portions is provided upstream in the rotary direction of the developer carrier with respect to the first sealing member, and downstream in the rotary direction of the developer carrier with respect to the development position. This arrangement completely prevents that the floating toner emit to the image forming apparatus through the aperture where the developer carrier of the developing device main body is exposed.

What is claimed is:

1. An image forming apparatus comprising:

(a) an image carrier on which a latent image is formed;

(b) a developing device for developing the latent image to form a toner image, comprising:

(1) a developer carrier provided opposite to the image carrier for carrying a magnetic brush formed by a developer on an outer circumferential surface thereof, and (2) a magnetic field generating member provided inside the developer carrier for generating a magnetized area of the magnetic brush in a predetermined area in an axis direction on the developer carrier; and (c) a scattered toner sucking port provided in a position other than a position opposite to the magnetized area for sucking a scattered toner, wherein the scattered toner sucking port is provided downstream of a developing position at which a toner is transferred from the developer carrier onto the image carrier, in a rotary direction of the developer carrier.

2. The image forming apparatus of claim 1, wherein the scattered toner sucking port is provided in the vicinity of a developing device main body in the vicinity of both ends of the developer carrier in an axis direction of the developer carrier.

3. The image forming apparatus of claim 2, wherein the scattered toner sucking port is provided in the vicinity of a side wall of the developing device main body which faces a side surface of the developer carrier.

4. The image forming apparatus of claim 1, further comprising a fan connected to the scattered toner sucking port.

5. An image forming apparatus comprising:

(a) an image carrier on which a latent image is formed;

(b) a developing device for developing the latent image to form a toner image, comprising:

(1) a developer carrier provided opposite to the image carrier for carrying a magnetic brush formed by a developer on an outer circumferential surface thereof, and (2) a magnetic field generating member provided inside the developer carrier for generating a magnetized area of the magnetic brush in a predetermined area in an axis direction on the developer carrier; and (c) a scattered toner sucking port provided in a position other than a position opposite to the magnetized area for sucking a scattered toner, wherein the developing device comprises an opening portion at a predetermined position of a side wall of a developing device main body in the vicinity of the developer carrier, and the scattered toner sucking port is provided in the vicinity of the opening portion, wherein the scattered toner sucking port is provided on the developing device in the vicinity of both ends of the developer carrier in an axis direction of the developer carrier, wherein the developing device further comprises a first sealing member provided downstream of a developing position at which a toner is transferred from the developer carrier onto the image carrier, in a rotary direction of the developer carrier, and on a part of the developing device between the developer carrier and the opening portion, for coming into soft contact with the outer circumferential surface of the developer carrier, and wherein the first sealing member has a length shorter than that of the developer carrier in the axis direction thereof and capable of covering at least a pad of each of the opening portions.

6. The image forming apparatus of claim 5, wherein the first sealing member has a length capable of covering completely each of the opening portions.

7. The image forming apparatus of claim 5, wherein the first sealing member is a conductive member, and has an electric potential equal to that of the developer carrier.

8. The image forming apparatus of claim 5, wherein the developing device further comprises an aperture of a developing area formed in an upper part of the developing device, at which the outer circumferential surface of the developer carrier opposite to the image carrier is exposed, and the first sealing member is obliquely attached to the developing device so that one end of the first sealing member which comes into contact with the outer circumferential surface is lower than the other end of the first sealing member.

9. The image forming apparatus of claim 5, wherein the first sealing member has a longitudinal length in which each of both ends thereof in a longitudinal direction is spaced by a distance of 5 mm or more away from each of inner walls of the developing device main body.

10. The image forming apparatus of claim 5, wherein the developing device further comprises a second sealing member provided upstream of the first sealing member in the rotary direction of the developer carrier, and downstream of the developing position at which the toner is transferred from the developer carrier onto the image carrier, the second sealing member having a length capable of covering completely each of the opening portions.

11. An image forming apparatus comprising:

(a) an image carrier on which a latent image is formed;

(b) a developing device for developing the latent image to form a toner image, comprising:

(1) a developer carrier provided opposite to the image carrier for carrying a magnetic brush formed by a developer on an outer circumferential surface thereof, (2) a magnetic field generating member provided inside the developer carrier for generating a magnetized area of the magnetic brush in a predetermined area on the developer carrier in an axis direction thereof, (3) an opening portion formed at a position on the developing device in the vicinity of both ends of the developer carrier in an axis direction thereof, and other than a position opposite to the magnetized area, and (4) a first sealing member provided downstream of a developing position at which a toner is transferred from the developer carrier onto the image carrier, in a rotary direction of the developer earner, and on a part of the developing device between the developer carrier and the opening portion, for coming into soft contact with the outer circumferential surface, wherein the first sealing member has a length shorter than that of the developer carrier in the axis direction thereof and capable of covering at least a part of each of the opening portions; and (e) a scattered toner sucking port provided in the vicinity of each of the opening portions of the developing device.

* * * * *